US005197400A

United States Patent [19]

Prais

[11] Patent Number: 5,197,400

[45] Date of Patent: Mar. 30, 1993

[54] TRIMMING APPARATUS FOR USE IN MAKING A HEM

[75] Inventor: Eugene R. Prais, West Milford, N.J.

[73] Assignee: Kansai Special USA Corp., Carlstadt, N.J.

[21] Appl. No.: 785,419

[22] Filed: Oct. 30, 1991

[51] Int. Cl.[5] ..... D05B 37/08; D05B 35/02

[52] U.S. Cl. ..... 112/122.3; 112/143; 112/147

[58] Field of Search ..... 112/122.3, 147, 141, 112/143, 122, 136, 129

[56] References Cited

U.S. PATENT DOCUMENTS

| | | | |
|---|---|---|---|
| 1,312,413 | 8/1919 | Moffatt | 112/122 |
| 1,442,387 | 1/1923 | Davis . | |
| 1,941,858 | 1/1934 | Gosman | 112/122 |
| 1,978,291 | 10/1934 | Bowman | 112/129 |
| 2,915,996 | 12/1959 | Charest | 112/122 |
| 3,257,979 | 6/1966 | Michaud | 112/129 X |
| 4,040,366 | 8/1977 | Silvermann et al. . | |
| 4,269,127 | 5/1981 | Kamiya . | |
| 4,287,841 | 9/1981 | Rovin . | |
| 4,491,079 | 1/1985 | Gustavsson . | |
| 4,879,960 | 11/1989 | Prais . | |

FOREIGN PATENT DOCUMENTS

| | | | |
|---|---|---|---|
| 739120 | 9/1943 | Fed. Rep. of Germany | 112/122 |
| 963059 | 7/1964 | United Kingdom | 112/122.3 |

*Primary Examiner*—Peter Nerbun
*Assistant Examiner*—Paul C. Lewis
*Attorney, Agent, or Firm*—Killworth, Gottman, Hagan & Schaeff

[57] ABSTRACT

A trimming apparatus adapted to be used with a sewing machine in order to form a hem is provided. The trimming apparatus includes a support member upon which the edge of a garment can be fed which is positioned upstream from the stitching needles of the sewing machine. A folder is attached to the trimming apparatus which is capable of folding the edge of the garment over an end of the support member such that the edge is in alignment with the stitching needles as the garment is fed along the support member. A stationary blade is mounted below and adjacent the end of the support member and is also aligned with the stitching needles. In addition, a rotatable blade is positioned adjacent to the stationary blade so as to cooperate with the stationary blade in a manner in which a predetermined portion of the edge is trimmed as the edge is folded. The trimming apparatus includes rotational gears and shafts for rotating the rotatable blade to permit the rotatable blade to cooperate with the stationary blade in such a manner.

20 Claims, 9 Drawing Sheets 10
12
14
16
18
19
20
22
24
26
28

TRIMMING APPARATUS FOR USE IN MAKING A HEM

BACKGROUND OF THE INVENTION

The present invention generally relates to sewing machine apparatus and more particularly, to an apparatus adapted to be used with a sewing machine for sewing an edge of a garment in order to form a hem.

In a variety of products involving a sewing operation, particularly in the manufacture of clothing, a piece of one fabric is sewn to a piece of another fabric with the two pieces being used to form a part of the finished product. An example of such an operation is involved in the manufacture of shirt cuffs. Each shirt cuff contains a lining between a top layer and a bottom layer of fabric. Conventionally, such a cuff is prepared by first cutting appropriate six strips of lining from a bolt of material, such as canvas. The bolt of lining material has to be carefully laid out in order to utilize it most efficiently resulting in an operation which is laborious, time-consuming and requires a skilled workman. Once the lining strips have been prepared, strips of shirt fabric are individually hemmed to each strip of lining. This is also a skilled operation which involves placing one strip of fabric on one strip of lining, folding a side of the fabric under the lining, then sewing the two together at the folded side. Further operations are performed ultimately resulting in the finished cuff. As exhibited from the foregoing discussion, the standard method for preparing shirt cuffs and the like involve several steps, each of which are time consuming and require the use of skilled labor resulting in expensive manufacturing costs.

There have been several attempts in the past for minimizing the problems associated with similar sewing operations. For example, Silverman et al, U.S. Pat. No. 4,040,366, provide a compact apparatus to be used in conjunction with a sewing machine for hemming a piece of material to a continuous band of material. As each piece is individually placed on the moving band, it passes through a mechanical folder which folds one side of the piece under the band after which the folded side is sewn to the band. A strip of the band carrying the piece is then cut away from the band and automatically removed into a stacker. The cutting apparatus disclosed by Silverman et al, however, is similar to the majority of prior art hemming apparatus in that they employ a conventional "scissor-type" cutting apparatus for trimming the irregularities often found in the raw edge of a hem as well as to ensure proper placement of the hem. Moreover, the "scissor-type" cutting apparatus have typically been located downstream from the folder, thereby increasing the bed circumference of the sewing machine to which it is attached. As those skilled in the art appreciate, the ability of sewing machines with large or increased bed circumferences are limited in their ability to manipulate and sew cuffs, waistbands and the like. Thus, it would be desirable to have cutting apparatus which decreases or, at least, maintains the bed circumference of a sewing machine.

It is often necessary to sharpen such cutting apparatus at some point during use of the sewing apparatus. The scissor-type cutting apparatus used in the past, however, are typically mounted integrally or within the sewing arm of sewing machines, thereby requiring considerable disassembly to access the cutting apparatus. Once the cutting apparatus is removed, use of special sharpening equipment is necessary adding further to the inconvenience and expense of past scissor-type cutting apparatus. The integral design also renders any notion of retrofitting such an apparatus difficult and impractical. Moreover, since past scissor-type cutting apparatus have been mechanically linked and driven by the crank shaft of the sewing machine, the costs and complexity of using such apparatus is relatively high.

Accordingly, there is a need in the art for a trimming apparatus adapted to be used with a sewing machine which facilitates the forming of a hem and which can be easily sharpened. There is also a need in the art for such an apparatus which decreases or, at least, maintains the overall bed circumference of a sewing machine. Additionally, there is a need in the art for an apparatus which can be retrofitted and possesses the capability of being self-driven.

SUMMARY OF THE INVENTION

The present invention meets the aforementioned needs by providing a trimming apparatus adapted to be used with a sewing machine which trims and properly aligns the workpiece edge when forming a hem and which is less expensive to operate. The trimming apparatus of the invention can be retrofitted and possesses the capability of being self-driven. Additionally, the trimming apparatus of the invention is advantageous in that it maintains the circumference of the sewing apparatus to which the trimming apparatus is attached. Maintenance of the circumference of the sewing apparatus is important in permitting the hemming and trimming of garments having, for example, small diameter cuffs. In that regard, the trimming or cutting mechanism of the trimming apparatus is mounted within the leaves of the folder so as to maintain such circumference.

In accordance with one aspect of the invention, an apparatus adapted to be used with a sewing machine having stitching means for sewing an edge of a garment in order to form a hem is provided. The trimming apparatus comprises a support member upon which the edge of the garment can be fed. The support member is positioned upstream from the stitching means. Further, the trimming apparatus includes folder means for folding the garment edge over an end of the support member such that the edge is in alignment with the stitching means as the garment is fed along the support member. A stationary blade is mounted below and adjacent the end of the support member such that the stationary blade is aligned with the stitching means. Additionally, a rotatable blade is positioned adjacent to the stationary blade which cooperates with the stationary blade to trim a predetermined portion of the garment edge as it is folded. The trimming apparatus is provided with rotation means for rotating the rotatable blade to permit the rotatable blade to cooperate with the stationary blade and trim the predetermined portion of the garment edge as it is folded.

In accordance with another aspect of the invention, an apparatus for folding and trimming an edge of a workpiece is provided which comprises a support member upon which the edge of the workpiece can be fed. In addition, folder means are included for folding the workpiece edge over an end of the support member such that the workpiece can be fed along the support member. A stationary blade is mounted below and adjacent the end of the support member and a rotatable blade is positioned adjacent to the stationary blade which cooperates with the stationary blade to trim a predetermined portion of the workpiece edge as it is folded. The apparatus also includes rotation means for rotating the rotatable blade to permit the rotatable blade to cooperate with the stationary blade and trim the predetermined portion of the workpiece edge as it is folded. Such an apparatus has use in environments beyond sewing of garments such as in producing drapery or other products made from fabric.

In accordance with yet another aspect of the invention, an apparatus for sewing an edge of a workpiece is provided which comprises stitching means for sewing an edge of a garment so as to form a hem. A support member upon which the edge of the workpiece can be fed is positioned upstream from the stitching means. The apparatus further comprises folder means for folding the edge over an end of the support member such that the edge is in alignment with the stitching means as the garment is fed along the support member. A stationary blade is mounted below and adjacent the end of the support member, the stationary blade being aligned with the stitching means. A rotatable blade positioned adjacent to the stationary blade and cooperating with the stationary blade to trim a predetermined portion of the edge as the edge is folded. The apparatus is provided with rotation means for rotating the rotatable blade to permit the rotatable blade to cooperate with the stationary blade and trim the predetermined portion of the edge as the edge is folded. Such an apparatus may be used to form hems in fabric-based products such as drapery and the like.

The apparatus of the invention may include extension means for extending the support member away from the stationary blade and the rotatable blade to facilitate feeding the garment or workpiece edge along the support means. The extension means may comprise a pneumatic cylinder capable of extending the support member outwardly so as to permit the hem to pass through the folder toward the stitching means to complete the hem. Additionally, the apparatus may include bar means for preventing the severing of the hem as it passes through the folder when the support means is extended. The apparatus of the invention may include sharpening means for sharpening the rotatable blade which is positioned adjacent the rotatable blade for contacting the cutting surface of the rotatable blade. The sharpening means in the apparatus may comprise a suitable stone flexibly mounted to a cover structure adjacent the rotatable blade such that the stone may be forced against the cutting surface of the rotatable blade so as to sharpen the cutting surface.

In accordance with another aspect of the invention, another apparatus is provided which is adapted to be used with a sewing machine having stitching means for sewing an edge of a garment in order to form a hem. The apparatus comprises a support member upon which the edge of the garment can be fed, the support member being positioned upstream from the stitching means. The apparatus further comprises folder means for folding the edge over an end of the support member such that the edge is in alignment with the stitching means as the garment is fed along the support member. The cutting means for trimming a predetermined portion of the edge as the edge is folded is located below and adjacent the folder means and the support member. Thus, the apparatus provides an improvement over those of the past in that it combines the folder means and cutting means together in a manner so as to decrease the circumference of the sewing machine to which the apparatus is attached. A drive means for driving the cutting means is provided so as to permit the cutting means to trim the predetermined portion of the edge as the edge is folded.

Accordingly, it is an object of the invention to provide a trimming apparatus adapted to be used with a sewing machine which can be easily sharpened; to provide such apparatus which facilitates the forming of a hem and which is less expensive to operate; and, to provide an apparatus which can be retrofitted such that the circumference of the sewing apparatus is maintained. Other objects and advantages of the invention will be apparent from the following detailed description, the accompanying drawings and the appended claims.

DETAILED DESCRIPTION OF THE PREFERRED EMBODIMENTS

Figure 1:
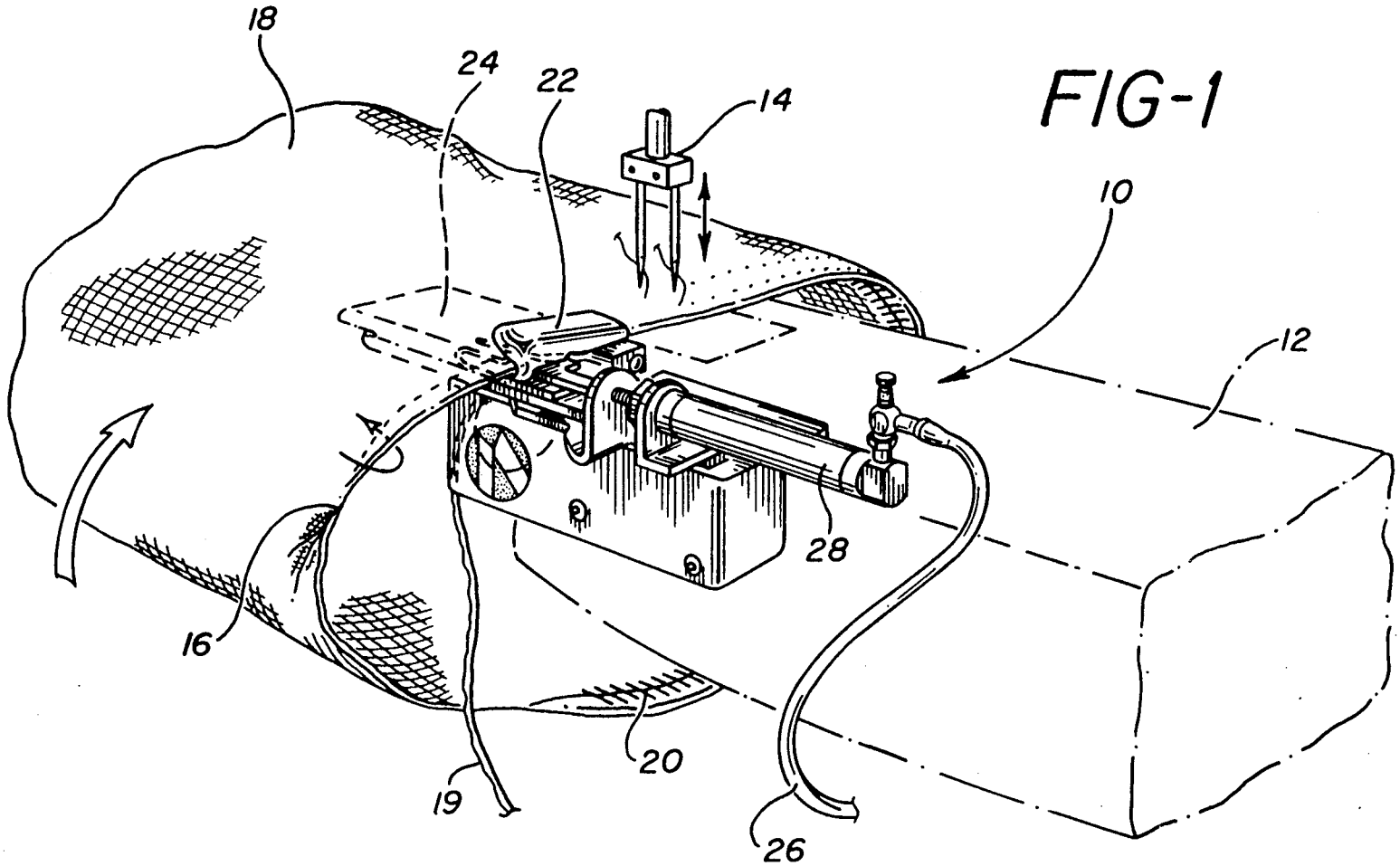
FIG. 1 is a perspective view of the trimming apparatus performing a trimming and hemming operation on a garment.

FIG. 1 illustrates a perspective view of a trimming apparatus 10 in accordance with the invention. The trimming apparatus 10 is most useful when used in conjunction with a sewing machine 12 having a stitching means, such as a pair of stitching needles 14, for sewing an edge 16 of a garment 18 while forming a hem 20. A by-product of this hemming operation is a trimmed portion 19 which is discarded as scrap. It should be understood that while the trimming apparatus 10 is described herein with respect to a garment 18, the trimming apparatus 10 is also suitable for use on other workpieces such as drapery, tents, and the like.

The trimming apparatus 10 comprises a folder means for folding an edge of a workpiece or garment in alignment with the stitching means. The preferred trimming apparatus 10 includes a fold member 22 which has a support member 24 mounted in the mouth of the U-shape of the fold member 22. It should be understood that the fold member 22 and the support member 24 are often times collectively referred to in the art as a folder. For purposes of description and clarity, however, the folder of the present invention is referred by its individual components, the folder member 22 (also referred to herein as folder means) and the support member 24, respectively. Those skilled in the art will appreciate that while the folder of the present invention comprises the fold member 22 and the support member 24, other structural components may be substituted therefore without departing from the scope of the invention. As seen in FIG. 1, the trimming apparatus 10 also includes an air line 26 connected to a pneumatic cylinder 28. The pneumatic cylinder 28 operates in a manner which permits the fold member 22 and the support member 24 to extend outwardly further into the garment 18 so as to facilitate the completion of the hem 20. This operation will be discussed more fully below.

Figure 2:
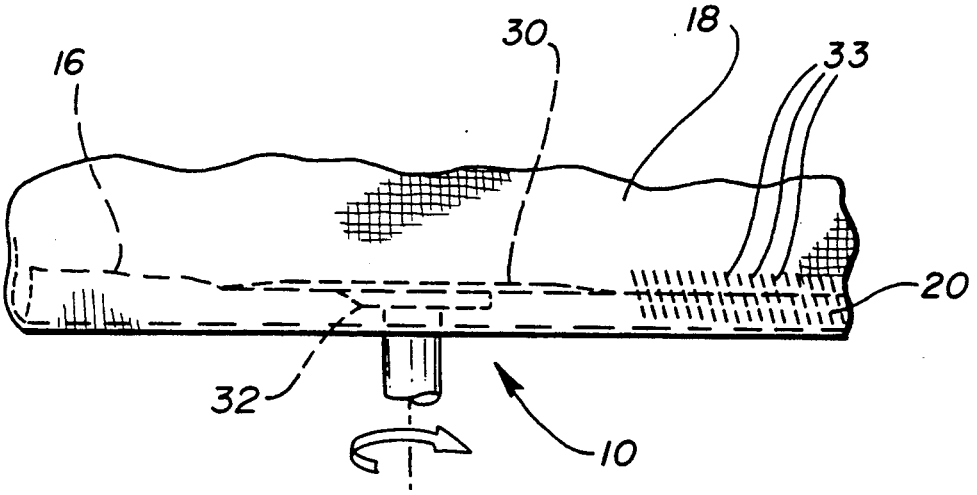
FIG. 2 is a fragmentary plan view of the garment and cutting region shown in FIG. 1.

Referring now to FIG. 2 as well as FIG. 1, the trimming or cutting action of the trimming apparatus 10 is illustrated. FIG. 2 shows a fragmentary plan view of the garment 18 both before the edge 16 is trimmed and after it has been formed into the hem 20. For purposes of clarity, the fold member 22 and the support member 24 are not shown in FIG. 2. As partially seen in FIG. 2, the trimming apparatus 10 is provided with a rotatable blade 30 which cooperates with a stationary blade 32 (best seen in FIG. 8) to trim the irregular portion of edge 16 as the garment 18 is fed along the support member 24. When forming the hem 20, it is preferable for the edge 16 to be aligned such that it passes directly between the stitching needles 14. In this way, proper covering stitches 33 are formed. Thus, the trimming apparatus 10 not only trims the edge 16 but also aligns the edge 16 of the garment 18 with the stitching needles 14 in a manner which permits the formation of the covering stitches 33. It should be understood that while the preferred cutting means comprises the aforedescribed apparatus, other known cutting apparatus such as the "scissor-type" cutting mechanisms may be mounted similar to the stationary blade 32 to provide smaller bed circumferences for the sewing machine. Such a result is especially desirable when using the sewing machine to sew cuffs, waistbands and the like.

Figure 3:
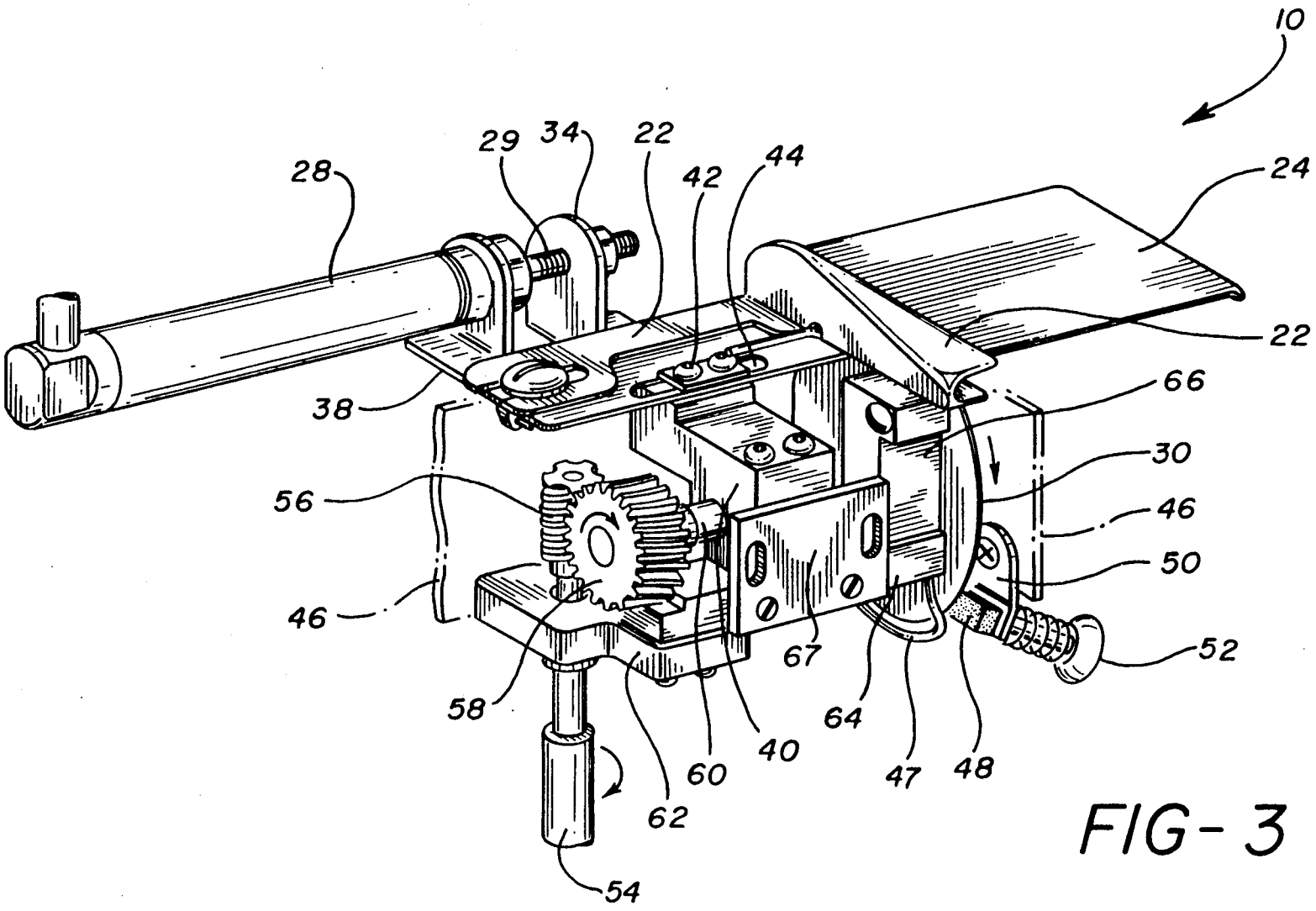
FIG. 3 is a perspective view of the trimming apparatus from an angle opposite to that of which is illustrated in FIG. 1.

Referring now to FIG. 3, a perspective view of the trimming apparatus 10 is shown. For purposes of clarity, the garment 18 or other workpiece has been omitted. The functionality of the pneumatic cylinder 28 is more clearly exhibited in that it is provided with a threaded shaft 29 which is connected to a slidable bracket 34. The slidable bracket 34 is fastened to the support member 24 through an aperture 36 in a base plate 38. The aperture 36 is most clearly seen in FIG. 9 which is discussed more fully below. A support block 40 is connected to the base plate 38 by a fastener 42 being interconnected through an aperture 44 in the base plate 38. The fastener 42 may comprise any screw, stud or combination of similar devices known in the art.

As a way of providing safe operation of the trimming apparatus 10, a guard plate 46 and a safety bar 47 are provided to shield exposure of the rotatable blade 30 to the operator of the trimming apparatus 10. The guard plate 46 includes a sharpening means for sharpening the rotatable blade 30 which comprises a sharpening stone 48 attached to a securing bracket 50 having an opening through which a resilient push tab 52 is secured to the sharpening stone 48. The operator of the trimming apparatus 10 can easily push the push tab 52 toward the rotatable blade 30 which engages the sharpening stone 48 against the rotatable blade 30 so as to sharpen its edge. This operation may occur whenever necessary or as the operator sees fit. The sharpening stone 48 may comprise any stone material suitable for sharpening the cutting surface of the rotatable blade 30.

The trimming apparatus 10 is provided with rotation means for rotating the rotatable blade 30 such that the trimming apparatus 10 may be considered self-driven. In that regard, the rotation means comprises a rotating shaft 54 secured to set of gears 56 and 58, respectively. The gears 56 and 58 operate together to translate the rotational motion of the rotating shaft 54 via a shaft 60 to the rotatable blade 30. For purposes of mounting the gears 54 and 58 as well as the shafts 54 and 60, the trimming apparatus 10 includes a set of plates 62 and 64 together which provide the requisite support and stability. The shaft 60 extends through the support block 40 and adjacent a beam 66 which supports the fold member 22 upon the plate 64 and ultimately to the rotatable blade 30. A fastening plate 68 is secured to the plate 64 and the support block 40 so as to hold the individual components together. A motor can be used to provide the necessary relation for the shaft 54 which ultimately rotates the rotatable blade 30. The motor is not illustrated as it does not form a material part of the invention.

Figure 4:
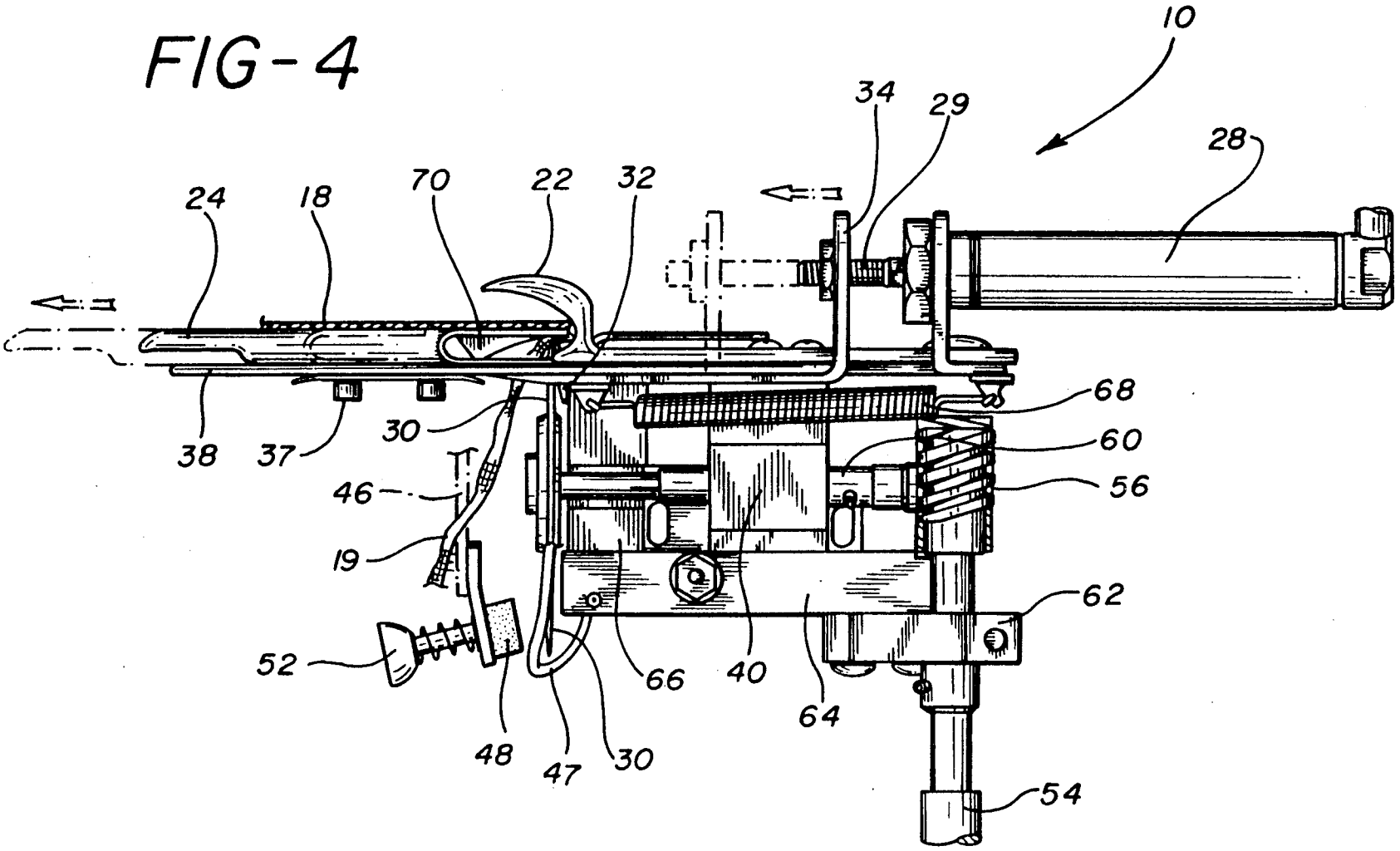
FIG. 4 is a front-end view of the trimming apparatus taken along view line 4—4 in FIG. 5 illustrating the extension capabilities of the support member upon which the garment is fed.
Figure 5:
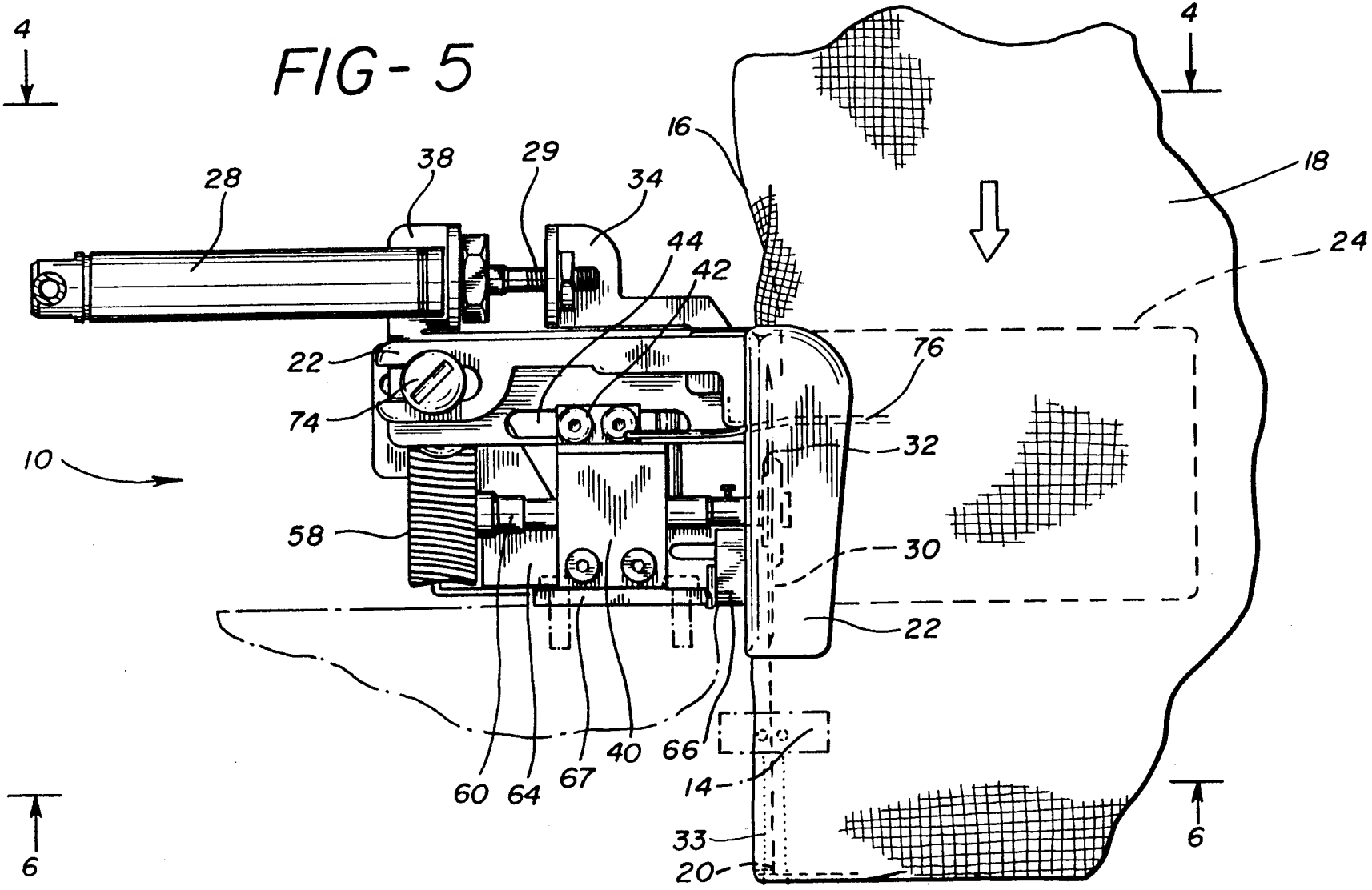
FIG. 5 is a plan view of the trimming apparatus shown in FIG. 1.
Figure 9:
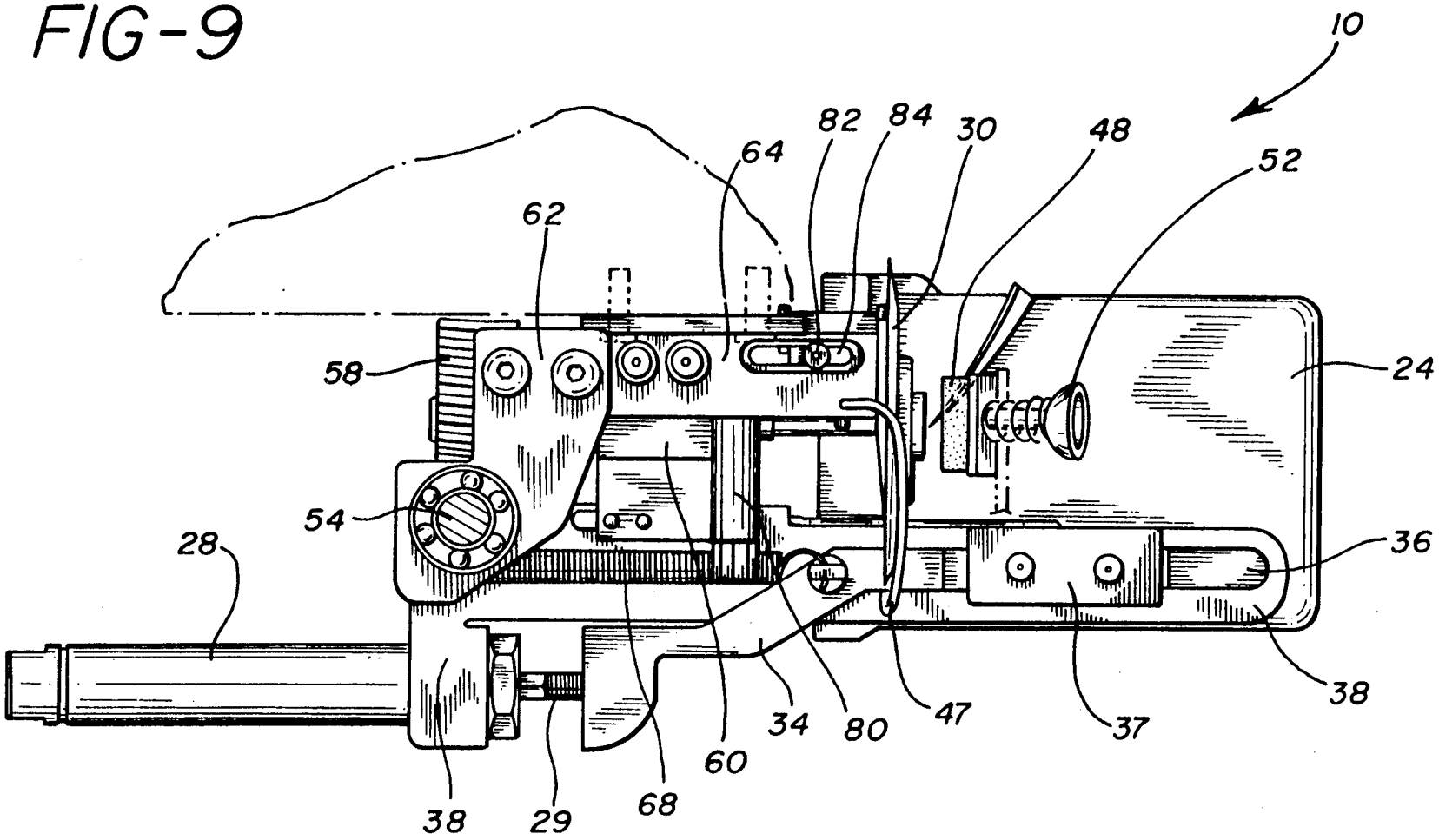
FIG. 9 is a bottom-view of the trimming apparatus taken along view line 9—9 in FIG. 6.

FIG. 4 is a front-end view of the trimming apparatus 10 taken along view line 4—4 in FIG. 5. As can be seen in FIG. 4, the fold member 22 preferably comprises a U-shaped member mounted such that the end of the support member 24 is contained within the mouth of the U-shaped member. The U-shaped member is designed such that the edge 16 of the garment 18 can be received in a manner by which the edge 16 is folded back upon itself as a means for preparing the garment 18 for hemming. FIG. 4 also clearly shows the extension capabilities of the support member 24 as indicated by the phantom lines which facilitate feeding the edge 16 of the garment 18 along the support member 24. As seen in FIG. 4, the slidable bracket 34 is extended longitudinally resulting from the expansion of the pneumatic cylinder 28 as controlled by the operator. FIG. 4 illustrates more clearly that the slidable bracket 34 is attached through the base plate 38 with a slidable fastener 37 to the support member 24. The slidable fastener 37 slides longitudinally with the support member 24 within the confines of the aperture 36 (FIG. 9). The slidable bracket 34 is capable of oscillating longitudinally as the pneumatic cylinder 28 extends and retracts the threaded shaft 29 to which the slidable bracket 34 is connected. The trimming apparatus 10 is provided with a spring 68 which provides resiliency for the extension operation and is interconnected between the base plate 38 and the slidable bracket 34.

As mentioned, the power source for the rotating shaft 54 can be any type of motor capable of generating the desired rotational motion for the rotating shaft 54. It is preferable for such a motor (not shown) to form part of the trimming apparatus 10 so as to allow retrofitting of the trimming apparatus 10 to a wide variety of sewing apparatus and to ease replacement of the trimming apparatus 10. An additional feature of the trimming apparatus 10 is a lip 70 which is secured to the undersurface of the support member 24. The lip 70 funnels or directs the trimmed portion 19 downwardly and away from the trimming apparatus 10 so as not to interfere with the cutting action performed by the rotatable blade 30 and the stationary blade 32 (most clearly seen in FIG. 8), the end of which is illustrated in FIG. 4.

Referring now to FIG. 5, a plan view of the trimming apparatus 10 is shown. The means by which the fold member 22 is attached to the base plate 38 comprises, for example, a screw 74 as seen in FIG. 5. FIG. 5 also provides a better view for illustrating the purpose of the extension capability of the trimming apparatus 10. As also depicted in FIG. 2, FIG. 5 shows the garment 18 being fed along the fold member 22 in order to form the hem 20 after passing through the needles 14 in proper alignment. If, for example, the garment 18 is a shirt cuff or a pant leg which requires hemming, the edge 16 will be continuously fed along the fold member 22 while the rotatable blade 30 and the stationary blade 32 cooperate with one another to trim the portion 19 from the edge 26. Simultaneously, the fold member 22 properly aligns the edge 16 with the needles 14. However, since the needles 14 are positioned downstream from the trimming apparatus 10, the first or initial covering stitches 33 formed in the hem 20 must pass through the fold member 22 again to complete the last portion of the hem 20. If the initial covering stitches 33 were permitted to pass through the fold member 22 again, those skilled in the art will appreciate that those covering stitches 33 will be cut with the rotatable blade 30 and the stationary blade 32.

Accordingly, the trimming apparatus 10 is provided with the aforedescribed extension capabilities which permit the initial covering stitches 33 in the hem 20 to pass through the fold member 22 without being cut. An additional necessary feature, however, is a bar means such as a wire bar 76 for preventing the severing of the hem 20 as it passes through the fold member 22. The wire bar 76 will be positioned in front of the stationary blade 32 when the fold member 22 is in its extended position as depicted in FIG. 4. In this way, the initial covering stitches 33 will most certainly pass over both the stationary blade 32 as well as the rotatable blade 30, thereby permitting the downstream un-hemmed portion of the edge 16 to pass through the needles 14 so as to complete the hem 20.

Figure 6:
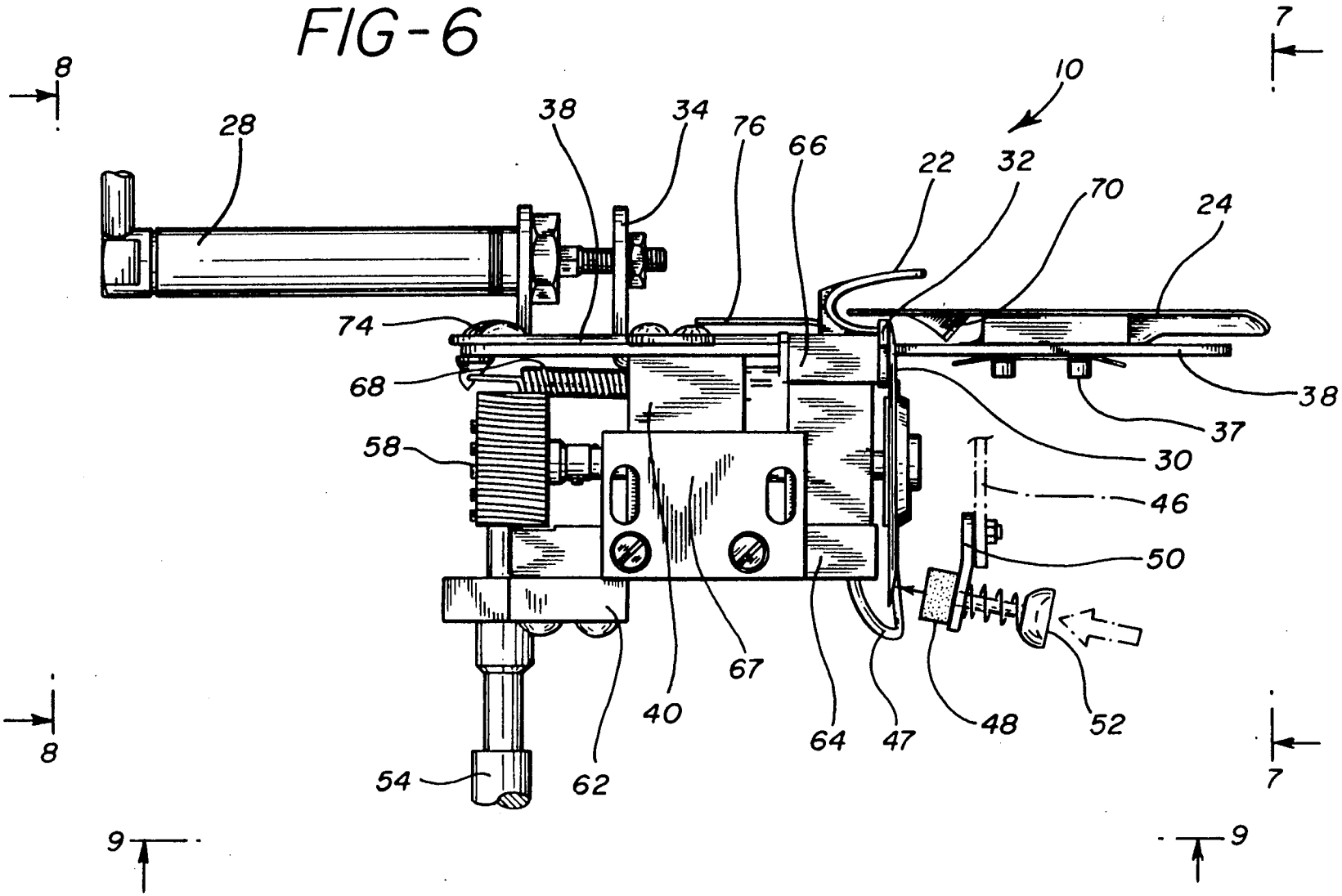
FIG. 6 is a back-end view of the trimming apparatus taken along view line 6—6 in FIG. 5.

FIG. 6 is a back-end view of the trimming apparatus 10 taken along view line 6—6 in FIG. 5. As seen in FIG. 6, the resilient push tab 52 may be pushed by the operator, thereby forcing the sharpening stone 48 against the rotatable blade 30 such that the rotatable blade 30 is provided with a keen edge. Obviously, such an operation must be performed while the rotatable blade 30 is rotating via the gear 58 and the rotating shaft 54. The back-end of the stationary blade 32 is illustrated in FIG. 6 to provide a better understanding for those skilled in the art. As seen in FIG. 6, the lip 32 is substantially adjacent the stationary blade 32 such that as the stationary blade 32 and the rotatable blade 30 cooperate with one another to trim the edge 16 of the garment, the resulting trimmed portion 19 is immediately funnelled down and away from the trimming apparatus 10 so as not to interfere with any further trimming operations.

FIG. 6 also provides a better view of the interrelation of the base plate 38 and the support member 24 as connected by the slidable fastener 37. The slidable fastener 37 is both capable of sliding in the aperture 36 when the support member 24 is extended to complete the hem 20. Additionally, the slidable fastener 37 is capable of attaching the support member 24 to the base plate 38. As those skilled in the art will appreciate, many fastener devices may be used to connect the individual components of the trimming apparatus 10 together. As discussed previously, when the support member 24 is its extended position near the completion of the hem 20, the wire bar 76 in conjunction with the extension means is used to prevent the initial covering stitches 33 in the hem 20 from being severed so as to permit the last portion of the garment 18 to be stitched downstream by the needles 14.

The position of the wire bar 76 when the support member 24 is not extended is shown in FIG. 6 to be to the side of the fold member 22 so that it does not interfere with the trimming operations until necessary. The spring 68 is interconnected between the base plate 38, which remains stationary during the extension and the slidable bracket 34. As a result, the spring 28 provides a needed resiliency for the trimming apparatus 10 0 when the operator activates the pneumatic cylinder 28 to initiate the extension of the support plate 24. The operator may accomplish this in a wide variety of ways, such as with a foot pedal pneumatically attached to the pneumatic cylinder 28. Those skilled in the art will appreciate that other similar methods for such activation may be used with the trimming apparatus 10 without departing form the scope of the invention.

Figure 7:
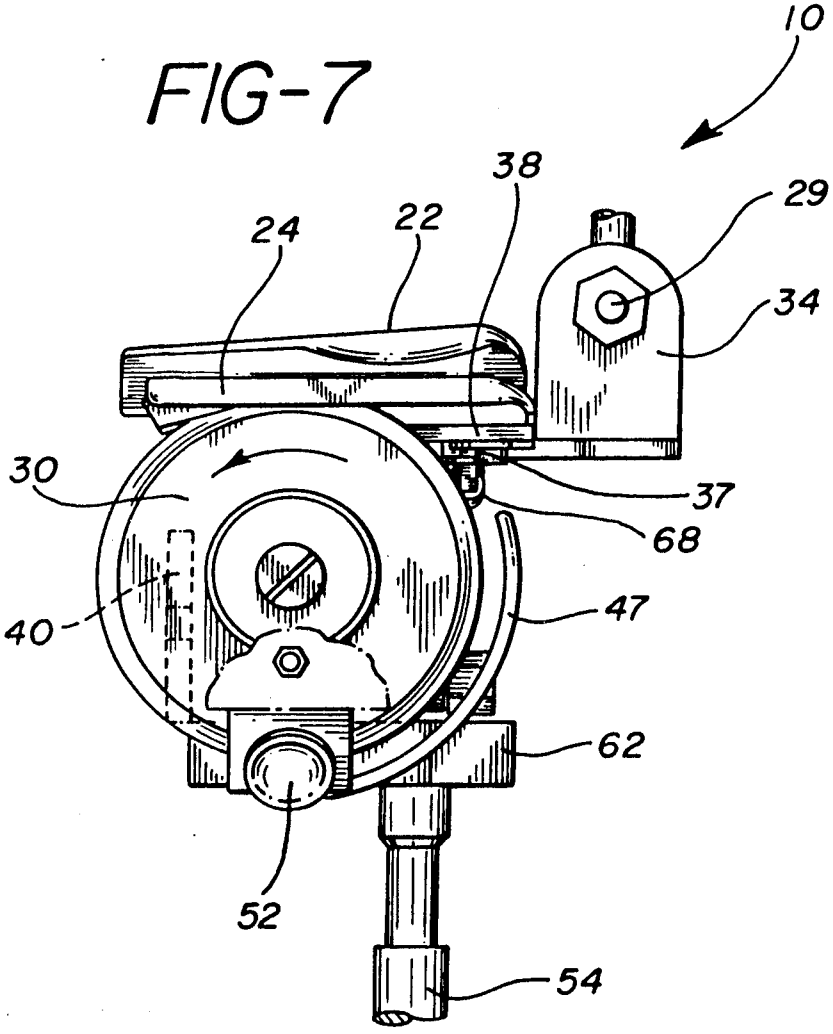
FIG. 7 is an end-view of the trimming apparatus taken along view line 7—7 in FIG. 6.

FIG. 7 illustrates a view of the trimming apparatus 10 taken along view line 7—7 in FIG. 6. By rotating the rotating shaft 54 in the appropriate direction, the rotatable blade 30 is rotated in a counterclockwise direction as viewed in FIG. 7. As partially seen in FIG. 7, the spring 68 is connected to the base plate 38 slightly below the slidable fastener 37. The safety bar 47 preferably extends substantially around the circumference of the rotatable blade 30 to give added protection for the operator. Preferably, the push tab 52 is positioned at the lowest point of the rotatable blade 30 so as not to interfere with the trimming operation of the trimming apparatus 10.

Figure 8:
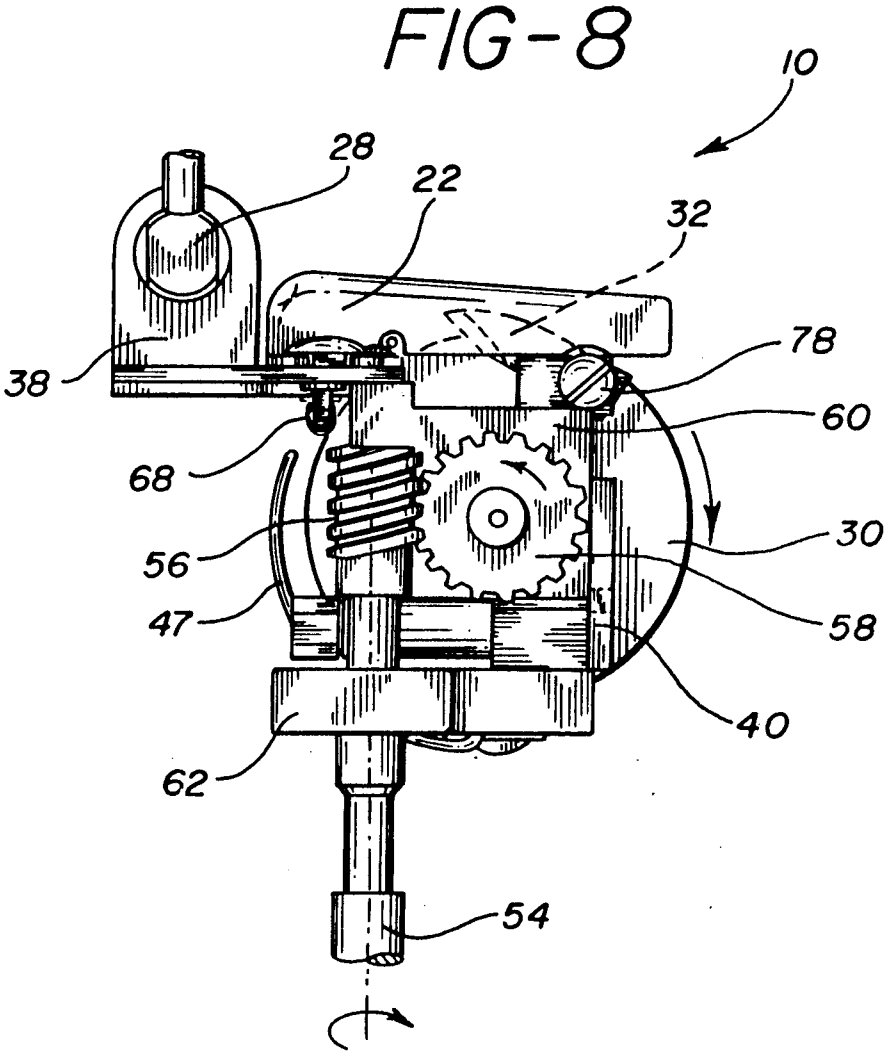
FIG. 8 is an end-view of the trimming apparatus taken along view line 8—8 in FIG. 6.

Referring now to FIG. 8, yet another view of the trimming apparatus 10 taken along view line 8—8 in FIG. 6 is illustrated. FIG. 8 provides a clear view of the stationary blade 32 which is positioned so as to cooperate with the rotatable blade 30 resulting in the desired trimming or cutting action. The stationary blade 32 is secured to the beam 66 with a screw 78. Of course, those skilled in the art will appreciate that other devices may be used in the trimming apparatus 10 to position the stationary blade 32 in the preferred position without departing from the scope of the invention. By positioning the stationary blade 32 and the rotatable blade 30 as shown in FIG. 8, they are able to cooperate with one another to trim or cut a portion 19 from the edge 16 of the garment 18 in the desired manner.

FIG. 9 is a bottom view of the trimming apparatus 10 taken along view line 9—9 in FIG. 6. As seen clearly in FIG. 9, the slidable fastener 37 slides along the aperture 36 in the base plate 38. As discussed previously, the slidable fastener 37 interconnects the slidable bracket 34 and the support member 24 together such that they both slide longitudinally along the aperture 36 in the base plate 38. The beam 66 is secured to the plate 64 which has an aperture 84 through which an attachment stud 82 is passed. The beam 66 and the plate 64, together, provide support and rigidity for the trimming apparatus 10. Additionally, the trimming apparatus 10 is provided with a support shaft 80 which interconnects the plate 64 with the guard plate 46. It should be understood that the support structures such as the beam 66 and the guard plate 64 as well as the fasteners and screws are not critical features of the invention but merely serve as structural support components of the trimming apparatus 10.

Figure 10:
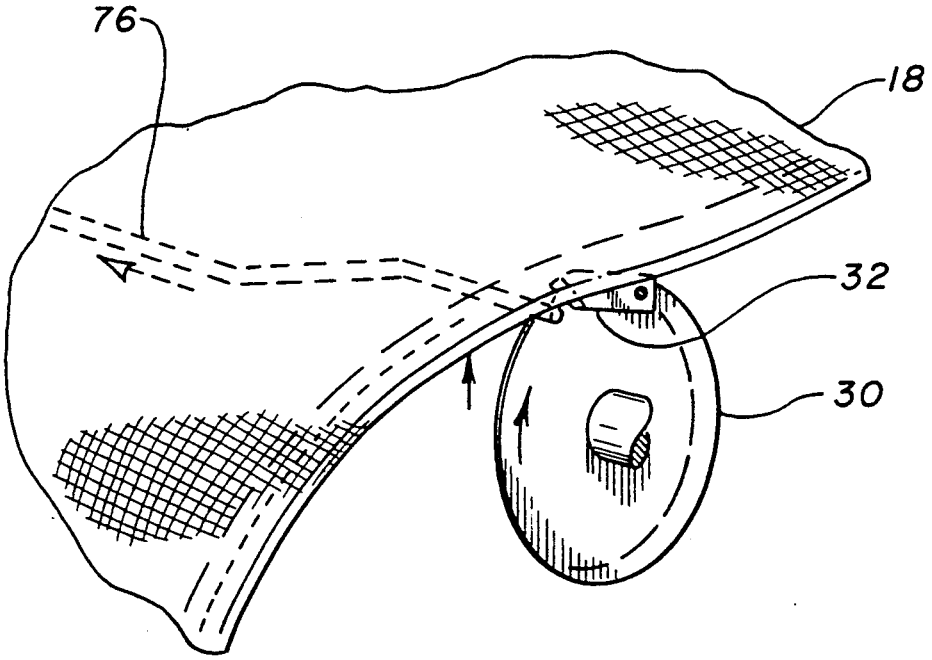
FIG. 10 is a fragmentary perspective view of FIG. 4 showing the garment, the stationary and rotatable blades, and the wire bar.
Figure 11:
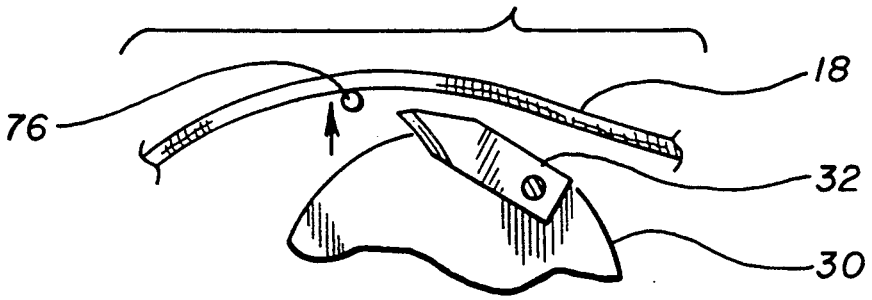
FIG. 11 is a fragmentary end view of FIG. 10 which better illustrates how the wire bar prevents the garment from being cut by the stationary and rotatable blades.

FIG. 10 is a fragmentary perspective view of FIG. 4 showing the garment 18, the stationary blade 32 and the rotatable blade 30, and the wire bar 76. As seen clearly in FIG. 10, the wire bar 76 is positioned in front of the stationary blade 32. This arrangement occurs when the fold member 22 is in its extended position as depicted in FIG. 4. The wire bar 76 causes the garment 18 to pass over both the stationary blade 32 and the rotatable blade 30 so as to prevent the garment 18 from being cut. As discussed above with reference to FIG. 4, this prevents the severing of hem 20 as it passes through the fold member 22. FIG. 11 is a fragmentary end view of FIG. 10 which better illustrates how the wire bar 76 prevents the stationary blade 32 and the rotatable blade 30 from cutting the garment 18. Accordingly, those skilled in the art will appreciate that components other than those described herein may be used without departing from the scope of the invention.

Having described the invention in detail and by reference to preferred embodiments thereof, it will be apparent that modifications and variations are possible without departing from the scope of the invention which is defined in the appended claims. For example, the fasteners and the support structures which hold the trimming apparatus 10 together may be substituted with fasteners and support structures having different designs than those of which are described herein.

What is claimed is:

1. An apparatus adapted to be used with a sewing machine having stitching means for sewing an edge of a garment in order to form a hem, said apparatus comprising:

a support member upon which said edge of said garment can be fed, said support member being positioned upstream from said stitching means;

folder means for folding said edge over an end of said support member such that said edge is in alignment with said stitching means as said garment is fed along said support member;

a stationary blade mounted below and adjacent said end of said support member, said stationary blade being aligned with said stitching means;

a rotatable blade positioned adjacent to said stationary blade and cooperating with said stationary blade to trim a predetermined portion of said edge as said edge is folded; and rotation means for rotating said rotatable blade to permit said rotatable blade to cooperate with said stationary blade such that said predetermined portion of said edge is trimmed as said edge is folded.

2. The apparatus as recited in claim 1 further comprising sharpening means for sharpening said rotatable blade, said sharpening means being positioned adjacent said rotatable blade for contacting the cutting surface of said rotatable blade.

3. The apparatus as recited in claim 2 wherein said sharpening means comprises a suitable stone mounted to a cover structure adjacent said rotatable blade such that said stone may be forced against the cutting surface of said rotatable blade.

4. The apparatus as recited in claim 1 wherein said folder means comprises a U-shaped member for receiving said edge in a manner by which said edge can be folded back upon itself, said U-shaped member being mounted such that said end of said support member is contained within the mouth of said U-shaped member.

5. The apparatus as recited in claim 1 wherein said folder means further comprises extension means for extending said support member away from said stationary blade and said rotatable blade to facilitate feeding said edge of said garment along said support means.

6. The apparatus as recited in claim 5 wherein said extension means comprises a pneumatic cylinder for extending said support member outwardly so as to permit said hem to pass through said folder means toward said stitching means to finish said hem, and bar means for preventing the severing of said hem as said hem passes through said folder means.

7. The apparatus as recited in claim 6 wherein said bar means comprises a wire bar mounted such that as said folder means extends outwardly, said wire bar forces said edge over from said rotatable blade and said stationary blade.

8. An apparatus for folding and trimming an edge of a workpiece comprising:

a support member upon which said edge of said workpiece can be fed;

folder means for folding said edge over an end of said support member such that said workpiece can be fed along said support member;

a stationary blade mounted below and adjacent said end of said support member;

a rotatable blade positioned adjacent to said stationary blade and cooperating with said stationary blade to trim a predetermined portion of said edge as said edge is folded; and rotation means for rotating said rotatable blade to permit said rotatable blade to cooperate with said stationary blade such that said predetermined portion of said edge is trimmed as said edge is folded.

9. The apparatus as recited in claim 8 further comprising sharpening means for sharpening said rotatable blade, said sharpening means being positioned adjacent said rotatable blade for contacting the cutting surface of said rotatable blade.

10. The apparatus as recited in claim 9 wherein said sharpening means comprises a suitable stone mounted to a cover structure adjacent said rotatable blade such that said stone may be forced against the cutting surface of said rotatable blade.

11. The apparatus as recited in claim 8 wherein said folder means comprises a U-shaped member for receiving said edge in a manner by which said edge can be folded back upon itself, said U-shaped member being mounted such that said end of said support member is contained within the mouth of said U-shaped member.

12. The apparatus as recited in claim 1 wherein said folder means further comprises extension means for extending said support member away from said stationary blade and said rotatable blade to facilitate feeding said edge of said workpiece along said support means.

13. An apparatus for sewing an edge of a workpiece comprising:

stitching means for sewing an edge of a garment so as to form a hem;

a support member upon which said edge of said workpiece can be fed, said support member being positioned upstream from said stitching means;

folder means for folding said edge over an end of said support member such that said edge is in alignment with said stitching means as said garment is fed along said support member;

a stationary blade mounted below and adjacent said end of said support member, said stationary blade being aligned with said stitching means;

a rotatable blade positioned adjacent to said stationary blade and cooperating with said stationary blade to trim a predetermined portion of said edge as said edge is folded; and rotation means for rotating said rotatable blade to permit said rotatable blade to cooperate with said stationary blade such that said predetermined portion of said edge is trimmed as said edge is folded.

14. The apparatus as recited in claim 13 further comprising sharpening means for sharpening said rotatable blade, said sharpening means being positioned adjacent said rotatable blade for contacting the cutting surface of said rotatable blade.

15. The apparatus as recited in claim 14 wherein said sharpening means comprises a suitable stone mounted to a cover structure adjacent said rotatable blade such that said stone may be forced against the cutting surface of said rotatable blade.

16. The apparatus as recited in claim 13 wherein said folder means comprises a U-shaped member for receiving said edge in a manner by which said edge can be folded back upon itself, said U-shaped member being mounted such that said end of said support member is contained within the mouth of said U-shaped member.

17. The apparatus as recited in claim 13 wherein said folder means further comprises extension means for extending said support member away from said stationary blade and said rotatable blade to facilitate feeding said edge of said workpiece along said support means.

18. The apparatus as recited in claim 17 wherein said extension means comprises a pneumatic cylinder for extending said support member outwardly so as to permit said hem to pass through said folder means toward said stitching means to finish said hem, and bar means for preventing the severing of said hem as it passes through said folder means.

19. The apparatus as recited in claim 18 wherein said bar means comprises a wire bar mounted such that as said folder means extends outwardly, said wire bar forces said edge over said rotatable blade and stationary blade.

20. The apparatus as recited in claim 17 wherein said extension means comprises a pneumatic cylinder from which a shaft extends, said shaft being connected to a slidable bracket which is attached to the support member such that said support member is extended away from said rotatable blade and said stationary blade as said pneumatic cylinder forces said shaft against said slidable bracket.

* * * * *